US011226088B2

(12) United States Patent
Lan et al.

(10) Patent No.: US 11,226,088 B2
(45) Date of Patent: Jan. 18, 2022

(54) LAMP BASE ASSEMBLY AND LAMP

(71) Applicant: SHENZHEN GUANKE TECHNOLOGIES CO., LTD, Shenzhen (CN)

(72) Inventors: Qing Lan, Shenzhen (CN); Ligen Liu, Shenzhen (CN); Shoubao Chen, Shenzhen (CN); Tianlong Dai, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/898,695

(22) Filed: Jun. 11, 2020

(65) Prior Publication Data

US 2021/0356103 A1 Nov. 18, 2021

(30) Foreign Application Priority Data

May 15, 2020 (CN) ..... 202010422317.X

(51) Int. Cl.
*F21V 21/02* (2006.01)
*F21V 15/00* (2015.01)
*F21V 21/08* (2006.01)

(52) U.S. Cl.
CPC ..... *F21V 21/02* (2013.01); *F21V 15/00* (2013.01); *F21V 21/08* (2013.01)

(58) Field of Classification Search
CPC ..... F21V 21/06; F21V 21/08; H01H 5/24; H01H 5/00; F16M 11/38
See application file for complete search history.

(56) References Cited

U.S. PATENT DOCUMENTS 5,465,196 A * 11/1995 Hasenberg ..... F21L 4/00 362/183
2004/0209210 A1* 10/2004 Long ..... F21V 3/00 431/111
2005/0286254 A1* 12/2005 Richardson ..... F21V 21/06 362/388
2006/0133074 A1* 6/2006 Lai ..... F21V 21/06 362/205
2011/0279034 A1* 11/2011 Lucas ..... F21V 23/0464 315/92
2014/0321106 A1* 10/2014 Workman ..... F21V 21/06 362/183
2015/0330558 A1* 11/2015 Intravatola ..... F16M 11/28 362/184
2018/0266657 A1* 9/2018 Brandt ..... F21V 23/005
2019/0063696 A1* 2/2019 Grandadam ..... H05B 45/10
2019/0203890 A1* 7/2019 Moore ..... F21S 8/033

* cited by examiner

*Primary Examiner* — Jong-Suk (James) Lee
*Assistant Examiner* — Eric T Eide
(74) *Attorney, Agent, or Firm* — Maier & Maier, PLLC

(57) ABSTRACT

A lamp base assembly and a lamp. The lamp base assembly includes: a base body, the light emitting module being provided on a surface of the base body; and supporting feet, the supporting feet being movably provided on a surface of the base body away from the light emitting module; the supporting feet are configured to move relative to the base body and protrude from a periphery of the base body when the lamp base assembly is in an unfolded state, and the supporting feet are configured to move relative to the base body and close to each other when the lamp base assembly is in a folded state.

13 Claims, 8 Drawing Sheets

LAMP BASE ASSEMBLY AND LAMP

CROSS-REFERENCE TO RELATED APPLICATIONS

This application claims the priority of Chinese Patent Application No. 202010422317X filed on May 15, 2020, the disclosure of which is incorporated herein by reference.

FIELD

The present disclosure relates to the field of lamp equipment, in particular to a lamp base assembly and a lamp using the lamp base assembly.

BACKGROUND

Generally, the size of the lamp base assembly needs to be designed to be large, and the weight of the base (such as the base of the table lamp) needs to be increased, such that the lamp is more stable and does not fall over. Due to the large volume of the lamp base assembly, the lamp base assembly occupies a large space, and the lamp base assembly is heavy, which makes it difficult to handle the product during transportation.

The above contents are only used to help understand the technical solution of the present disclosure, and do not mean that the above contents are recognized as prior art.

SUMMARY

The main objective of the present disclosure is to provide a lamp base assembly, which aims to reduce the occupied area of the lamp base assembly and improve the adaptability of the lamp base assembly to the environment.

In order to achieve the above objective, the present disclosure provides a lamp base assembly for mounting a light emitting module, including:

a base body, the light emitting module being provided on a surface of the base body; and supporting feet, the supporting feet being movably provided on a surface of the base body away from the light emitting module;

the supporting feet are configured to move relative to the base body and protrude from a periphery of the base body when the lamp base assembly is in an unfolded state, and the supporting feet are configured to move relative to the base body and close to each other when the lamp base assembly is in a folded state.

In an embodiment of the present disclosure, a surface of the base body towards the supporting feet is convexly provided with positioning posts, the positioning posts are provided along a periphery of the base body; and each of the supporting feet is provided with a mounting hole, a fixing member is connected to the positioning post through the mounting hole, thereby the supporting feet are rotatably provided on the base body.

In an embodiment of the present disclosure, the base body includes:

a connecting portion configured for electrically connecting with the light emitting module, a surface of the connecting portion away from the light emitting module being provided with a mounting groove;

a base connected to the connecting portion and configured to cover a notch of the mounting groove, the positioning posts being provided on a surface of the base away from the connecting portion, a surface of the base towards the connecting portion being convexly provided with mounting pins, one of the mounting pins and one of the positioning posts being misplaced, the base being also provided with avoiding grooves, one of the avoiding grooves being adjacent to one of the positioning posts and one of the mounting pins; and elastic members, one end of one of the elastic members being connected to one of the mounting pins;

a side of each of the supporting feet towards the base is convexly provided with a positioning pin, the positioning pin being slidably penetrated in the avoiding groove and connected to one end of one of the elastic members away from one of the mounting pins, the elastic member being configured to apply a force to the mounting pin towards either end of the avoiding groove.

In an embodiment of the present disclosure, one end of the avoiding groove is adjacent to a middle of the base, and another end of the avoiding groove is adjacent to a periphery of the base;

a distance between the end of the avoiding groove adjacent to the middle of the base and the mounting pin is La, a distance between the end of the avoiding groove adjacent to the periphery of the base and the mounting pin is Lb, a distance between a middle of the avoiding groove and the mounting pin is Lc, La is less than Lc and no less than Lb.

In an embodiment of the present disclosure, a surface of the base away from the connecting portion is provided with convex portions, and one of the convex portions is adjacent to one of the positioning posts.

In an embodiment of the present disclosure, a side of each of the supporting feet away from the base body is provided with an avoiding slot;

the lamp base assembly further includes anti-skid pads, and one of the anti-skid pads is provided at the avoiding slot.

In an embodiment of the present disclosure, a mounting portion is provided in a middle of the base body, the supporting feet are configured to surround the mounting portion; and the lamp base assembly further includes a hanger ear detachably connected to the mounting portion.

In an embodiment of the present disclosure, the mounting portion is provided with an avoiding recess adjacent to each of the supporting feet.

The present disclosure further provides a lamp. The lamp includes a light emitting module and the lamp base assembly, the light emitting module is provided on the base body of the lamp base assembly and electrically connected to the base body.

In an embodiment of the present disclosure, the lamp further includes:

a reflecting cover, the reflecting cover being provided on a surface of the base body away from the supporting feet, a receiving groove being provided on a periphery of the reflecting cover, the light emitting module being received in the receiving groove;

protective collars sleeved on the reflecting cover, the protective collars being spaced apart from the base body to form a light passing area; and a sensing component, the sensing component being provided on a side of the reflecting cover away from the base body, the sensing component being electrically connected to the base body through a wire.

In the technical solutions of the present disclosure, supporting feet are provided on the base body, and the supporting feet may rotate relative to the base body, such that the supporting feet may rotate or slide relative to the base body, and expand towards the periphery of the base body. Alternatively, the supporting feet may rotate or slide relative to the base body, and fold towards the middle of the base body. The relative positions of the supporting feet and the base body have been adjusted according to the actual use of the lamp base assembly, so that the base body can be placed on the table surface through the supporting feet. Alternatively, the base body may be hanged between two beams according to supporting feet to improve the adaptability of the lamp base assembly to the environment. Meanwhile, the supporting feet may be movably provided on the base body, such that the supporting feet may be stored on the base body. The supporting feet can be flexibly adjusted according to the actual use, thereby reducing the occupied area of the lamp base assembly. In the present disclosure, when the supporting feet are folded, the occupied area of the lamp base assembly is reduced, and when the supporting feet are unfolded, the supporting stability of the base body is improved. Compared with the lamp base assembly in the folded state, the lamp base assembly in the unfolded state may support heavier objects, which is convenient for packaging and transportation. The lamp base assembly of the present disclosure improves the adaptability of the lamp base assembly to the environment.

BRIEF DESCRIPTION OF THE DRAWINGS

In order to more clearly illustrate the embodiments of the present disclosure or the technical solutions in the related art, the drawings used in the embodiments or the related art will be briefly described below. Obviously, the drawings in the following description are only some embodiments of the present disclosure. It will be apparent to those skilled in the art that other figures can be obtained from the structures illustrated in the drawings without the inventive effort.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the embodiments of the present disclosure (such as up, down, left, right, front, rear . . . ) can only be used for explaining relative position relations, moving condition of the elements under a special form (referring to figures), and so on, if the special form changes, the directional instructions changes accordingly.

In addition, the descriptions, such as the "first", the "second" in the embodiment of present disclosure, can only be used for describing the aim of description, and cannot be understood as indicating or suggesting relative importance or impliedly indicating the number of the indicated technical feature. Therefore, the feature indicated by the "first", the "second" can express or impliedly include at least one feature. Besides, the meaning of "and/or" appearing in the full text includes three schemes. Take "A and/or B" as an example, including A scheme, or B scheme, or the scheme in which both A and B are simultaneously satisfied. Besides, the technical solution of each embodiment can be combined with each other, however the technical solution must base on that the ordinary skill in that art can realize the technical solution, when the combination of the technical solutions is contradictory or cannot be realized, it should consider that the combination of the technical solutions does not exist, and is beyond the protection scope of the present disclosure.

Figure 1:
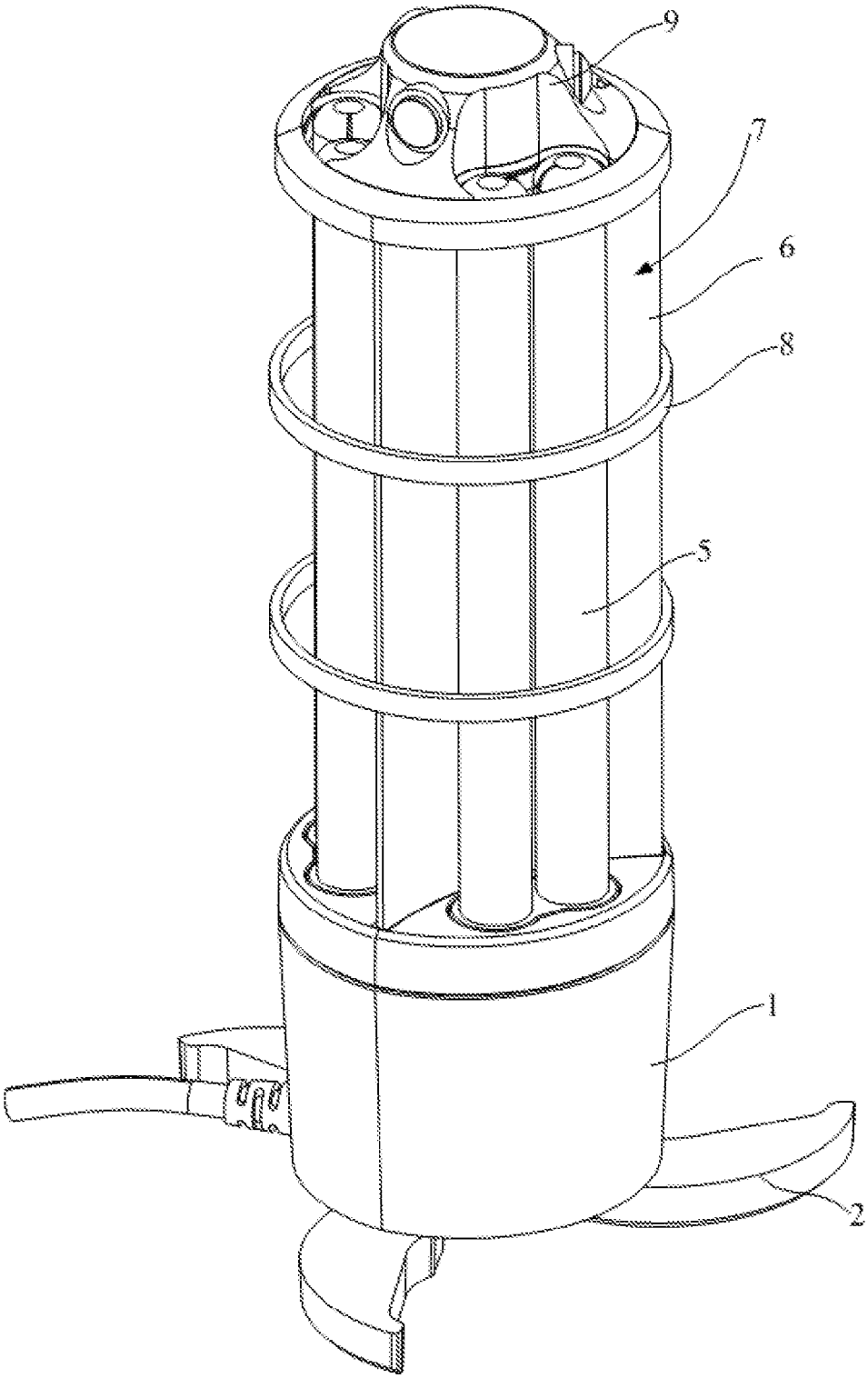
FIG. 1 is a schematic structural view of a lamp base assembly according to an embodiment of the present disclosure.
Figure 2:
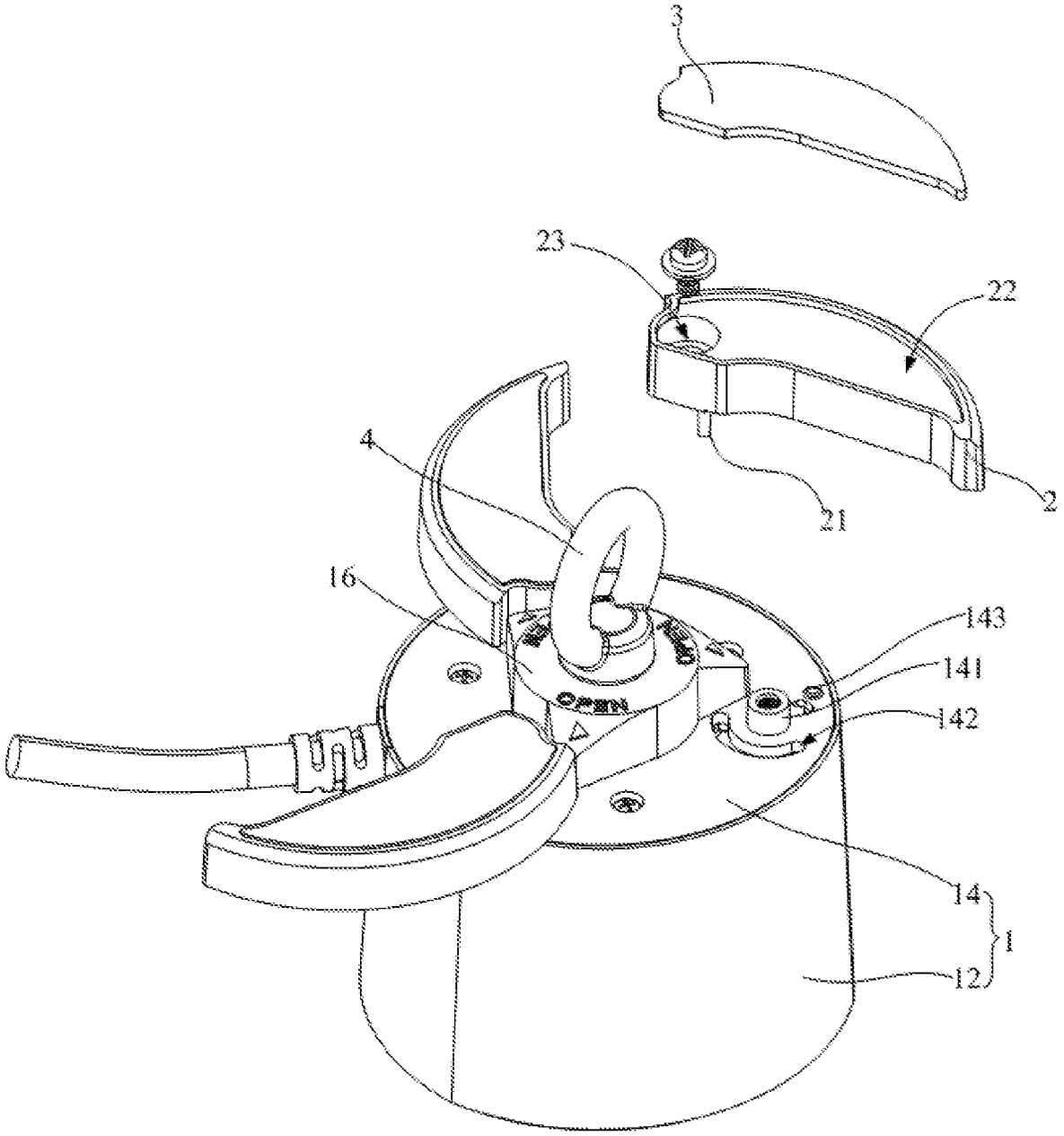
FIG. 2 is a schematic structural view of assembling the lamp base assembly in FIG. 1.
Figure 3:
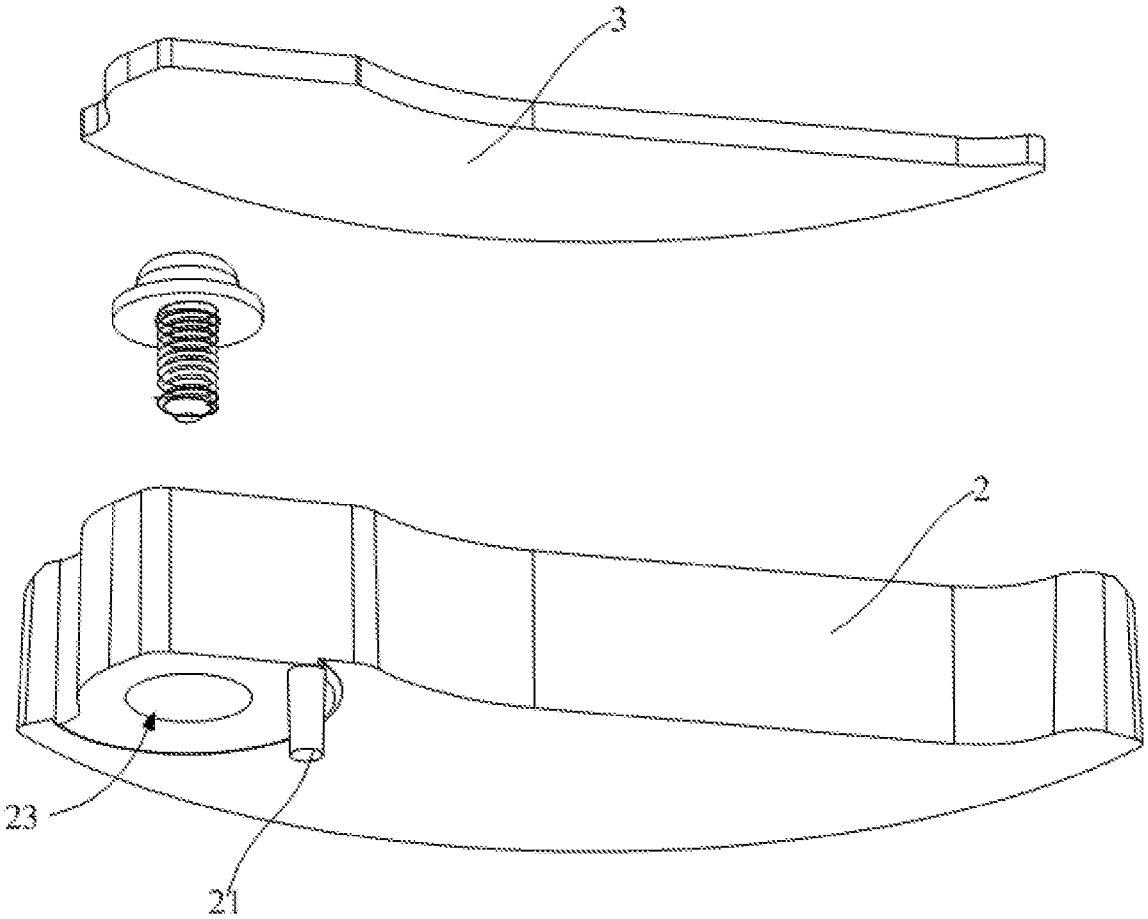
FIG. 3 is a schematic structural view of assembling supporting feet in FIG. 2.
Figure 4:
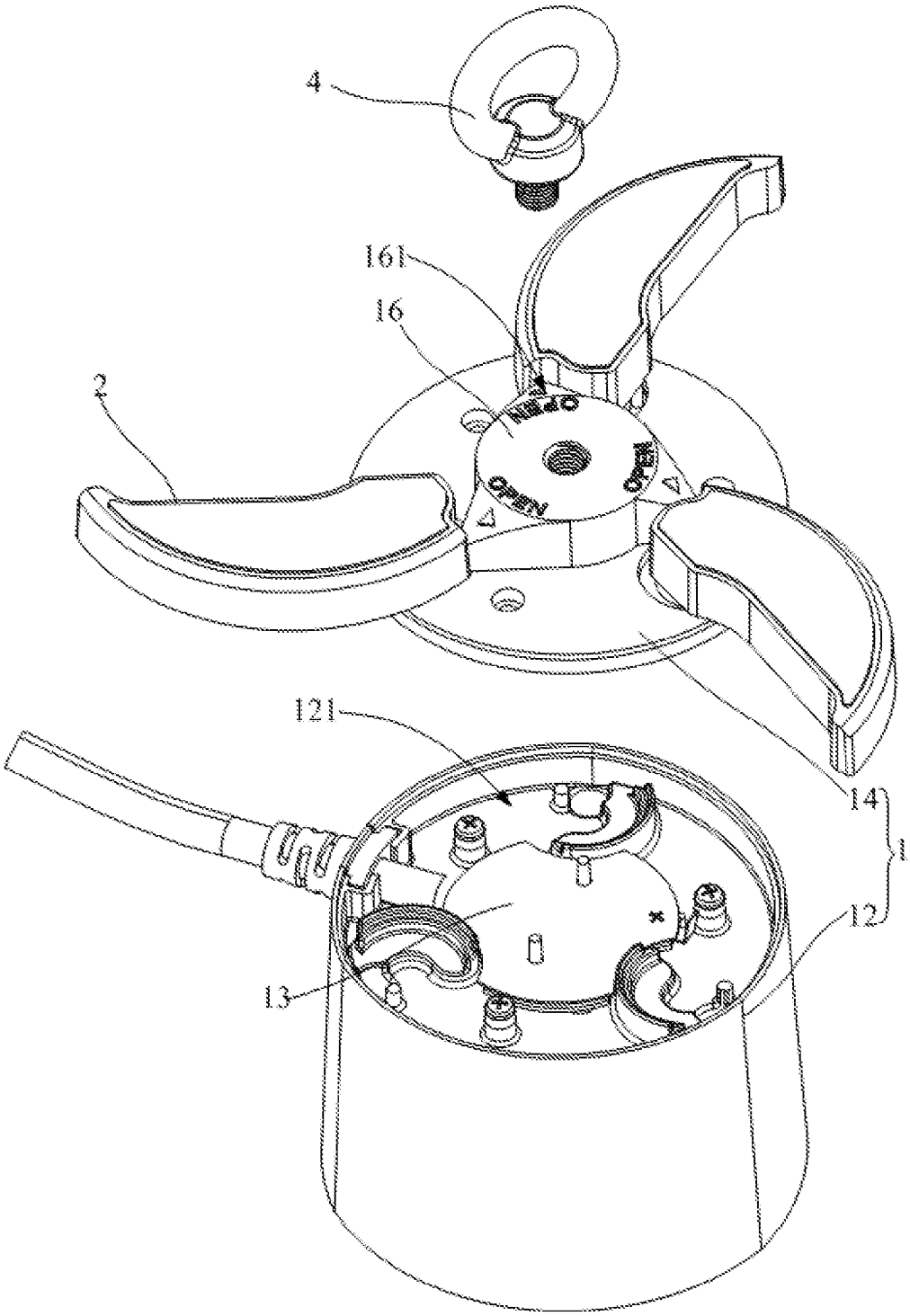
FIG. 4 is another schematic structural view of assembling the lamp base assembly in FIG. 1.
Figure 5:
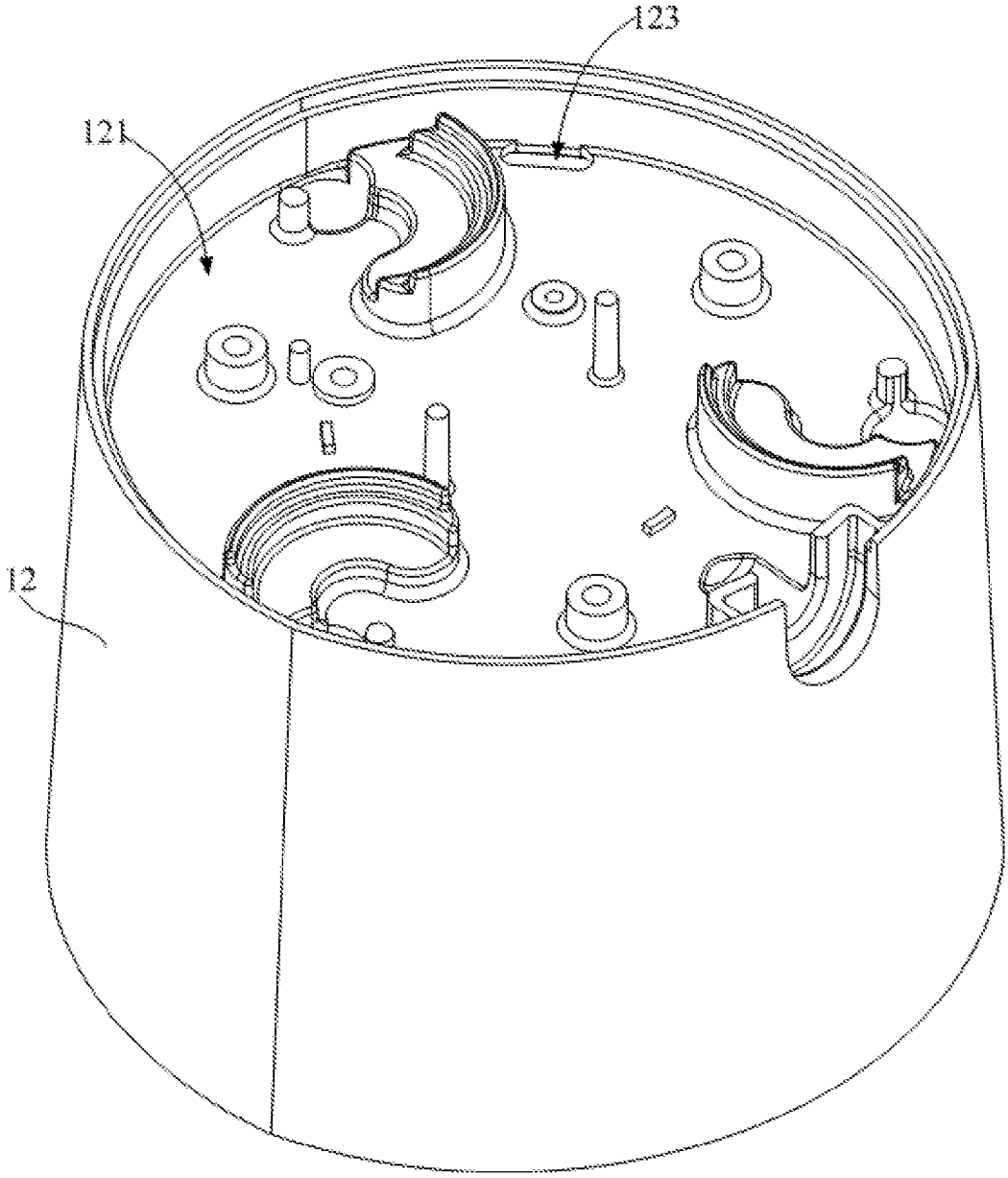
FIG. 5 is a schematic structural view of a connecting portion in FIG. 4.
Figure 6:
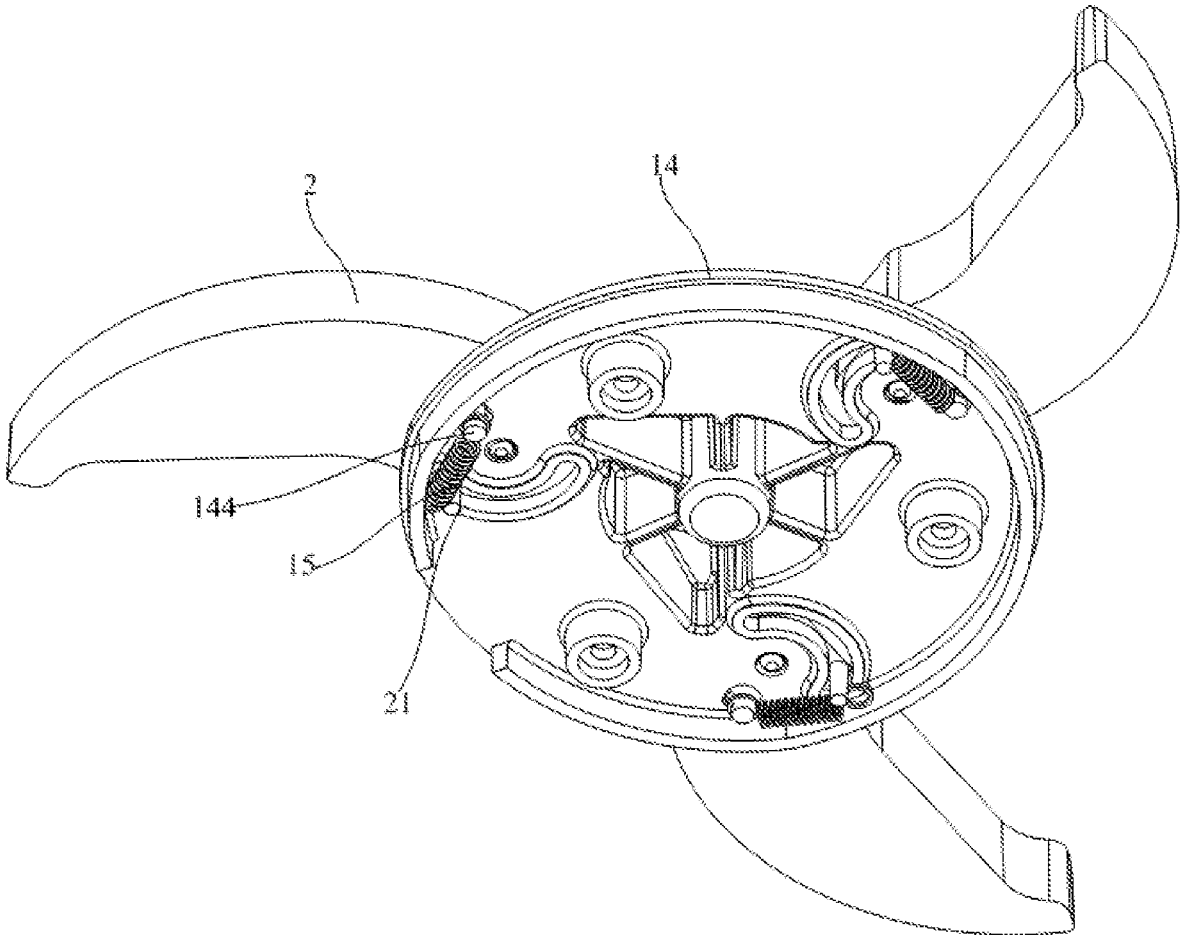
FIG. 6 is a schematic structural view of assembling a base and supporting feet in FIG. 4.
Figure 7:
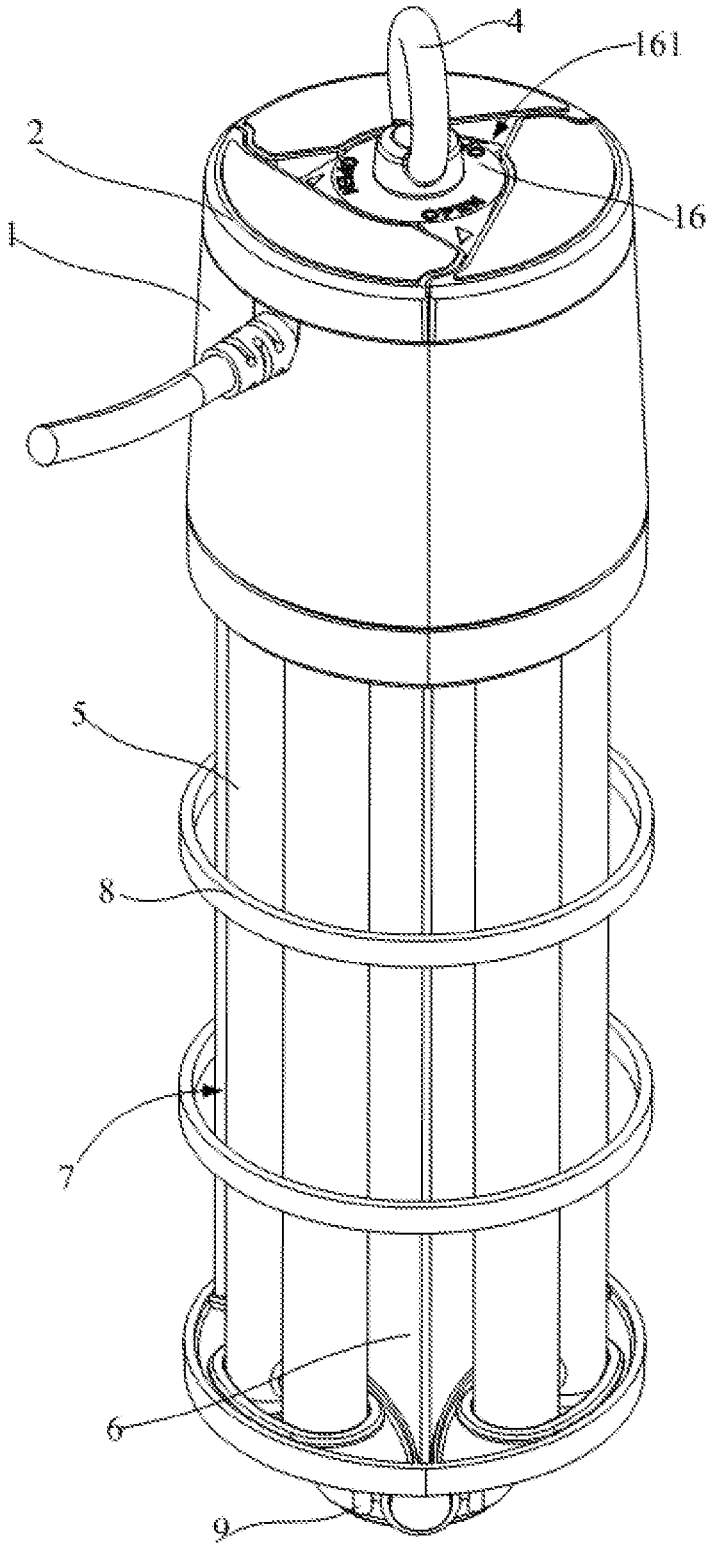
FIG. 7 is a schematic structural view of a lamp according to an embodiment of the present disclosure.
Figure 8:
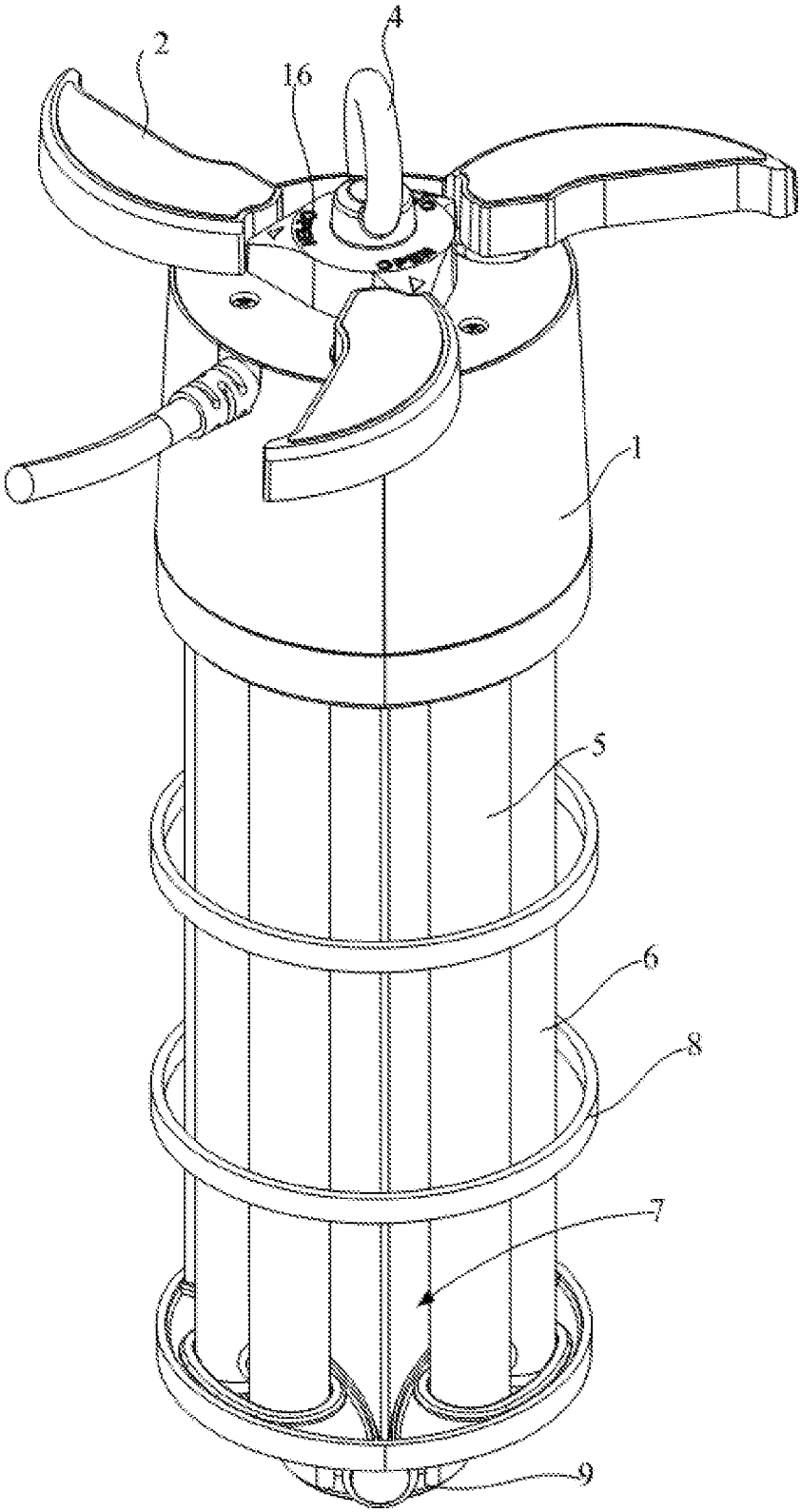
FIG. 8 is a schematic structural view of a lamp in FIG. 7 in another state. The realization of the objective, functional characteristics, advantages of the present disclosure are further described with reference to the accompanying drawings.

The present disclosure provides a lamp base assembly. Specially, FIG. 1 is a schematic structural view of a lamp base assembly according to an embodiment of the present disclosure; FIG. 2 is a schematic structural view of assembling the lamp base assembly in FIG. 1; FIG. 3 is a schematic structural view of assembling supporting feet in FIG. 2; FIG. 4 is another schematic structural view of assembling the lamp base assembly in FIG. 1; FIG. 5 is a schematic structural view of a connecting portion in FIG. 4; FIG. 6 is a schematic structural view of assembling a base and supporting feet in FIG. 4; FIG. 7 is a schematic structural view of a lamp according to an embodiment of the present disclosure; and FIG. 8 is a schematic structural view of a lamp in FIG. 7 in another state.

In an embodiment of the present disclosure, as shown in FIG. 1 and FIG. 2, the lamp base assembly includes a base body 1 and supporting feet 2. A light emitting module 5 is provided on a surface of the base body 1. The supporting feet 2 may be movably provided on a surface of the base body 1 away from the light emitting module 5. Each of the supporting feet 2 may be slidably or rotatably connected to the base body 1, that is to say, the supporting feet 2 may slide along the surface of the base body 1 away from the light emitting module 5, such that the supporting feet 2 protrude from the periphery of the base body 1. Alternatively, the supporting feet 2 may rotate along the surface of the base body 1 away from the light emitting module 5, each of the supporting feet 2 may rotate relative to the base body 1, such that the portion of the supporting feet 2 can protrude beyond the periphery of the base body 1.

In the present embodiment, the supporting feet 2 are configured to move relative to the base body 1 and protrude from a periphery of the base body 1 when the lamp base assembly is in an unfolded state, and the supporting feet 2 are configured to move relative to the base body 1 and close to each other when the lamp base assembly is in a folded state. That is to say, when in the folded state, the supporting feet 2 are close to each other, and are located in the orthographic projection area of the base body 1.

In the present embodiment, supporting feet 2 are provided on the base body 1, and the supporting feet 2 may rotate relative to the base body 1, such that the supporting feet 2 may rotate or slide relative to the base body 1, and expand towards the periphery of the base body 1. Alternatively, the supporting feet 2 may rotate or slide relative to the base body 1, and fold towards the middle of the base body 1. The relative positions of the supporting feet 2 and the base body 1 have been adjusted according to the actual use of the lamp base assembly, so that the base body 1 can be placed on the table surface through the supporting feet 2. Alternatively, the base body may be hanged between two beams according to supporting feet 2 to improve the adaptability of the lamp base assembly to the environment. Meanwhile, the supporting feet 2 may be movably provided on the base body 1, such that the supporting feet 2 may be stored on the base body 1. The supporting feet 2 can be flexibly adjusted according to the actual use, thereby reducing the occupied area of the lamp base assembly. In the present disclosure, when the supporting feet 2 are folded, the occupied area of the lamp base assembly is reduced, and when the supporting feet 2 are unfolded, the supporting stability of the base body 1 is improved. Compared with the lamp base assembly in the folded state, the lamp base assembly in the unfolded state may support heavier objects, which is convenient for packaging and transportation. The lamp base assembly of the present disclosure improves the adaptability of the lamp base assembly to the environment.

In an embodiment of the present disclosure, as shown in FIG. 4 and FIG. 5, the base body 1 is a module mounting base structure for connecting the light emitting module 5, that is to say, at least a circuit assembly 13 and at least one connecting structure are provided on the base body 1. The circuit assembly 13 is electrically connected to the connecting structure. The connecting structure is a metal contact or a metal plug. The light emitting module 5 may be provided on the base body 1 and electrically connected to the metal contact or the metal plug, such that the base body 1 provides power to the light emitting module 5.

Optionally, the circuit assembly 13 may include a circuit board and a battery provided on the circuit board. The battery provides electrical energy for the lamp base assembly.

Optionally, the circuit assembly 13 may include a circuit board, and a wire and a plug both electrically connected to the circuit board. The plug is electrically connected to the circuit board through the wire. The plug can serve as a connecting piece to the power supply network, such that the circuit assembly 13 is connected to the power supply network to provide power to the light emitting module 5.

In an embodiment of the present disclosure, the supporting feet 2 may slide along the surface of the base body 1 away from the light emitting module 5, that is to say, taking the structure of one supporting foot 2 and the base body 1 as an example, a sliding rail may be provided on one of the supporting foot 2 and the base body 1, and a sliding slot is provided on the other of the supporting foot 2 and the base body 1. The sliding rail is slidably disposed in the sliding slot, such that the supporting feet 2 are slidably connected to the base body 1.

Optionally, the sliding rail may be provided on each of the supporting feet 2, and sliding slots may be provided on the base body 1. Sliding slots are arranged radially with the center axis of the base body 1 as the center. Alternatively, the extension lines of two adjacent sliding slots are arranged in a staggered manner, and the extension lines of the slide slots intersect each other and form a structure of a deformed pattern in the middle of the base body 1.

In another embodiment of the present disclosure, the supporting feet 2 may rotate along the surface of the base body 1 away from the light emitting module 5, that is to say, taking the structure of one supporting foot 2 and the base body 1 as an example, a positioning post 141 may be provided on one of the supporting foot 2 and the base body 1, and a mounting hole 23 is provided on the other of the supporting foot 2 and the base body 1. The positioning post 141 is rotatably provided in the mounting hole 23 so that the supporting foot 2 and the base body 1 can be rotatably connected. In order to be able to stably set the support foot 2 on the base body 1, a screw can be screwed to the positioning post 141, such that the nut of the screw can be used to bear against the supporting foot 2 to avoid the supporting foot 2 from being detached from the base body 1.

In an embodiment of the present disclosure, as shown in FIGS. 1 to 6, a surface of the base body 1 towards the supporting feet 2 is convexly provided with positioning posts 141, and each of the supporting feet 2 is provided with a mounting hole 13, a fixing member is connected to the positioning post 141 through the mounting hole, such that the supporting feet 2 are rotatably provided on the base body 1. The fixing member may be a screw.

Optionally, the positioning posts 141 are arranged on the same circumference. Understandably, the positioning posts 141 are arranged on the same circumference, and one of the supporting feet 2 is provided on one of the positioning posts 141. When the supporting feet 2 are unfolded, the peripheral edge of the base body 1 can be evenly protruded, such that the peripheral edge of the base body 1 is evenly stressed.

Optionally, a surface of the base body 1 towards the supporting feet 2 is convexly provided with positioning posts 141. The positioning posts 141 are evenly arranged and on the same circumference, such that the supporting feet 2 are evenly arranged on the base 14, so as to improve the stability of placing the lamp base assembly.

Optionally, when the supporting feet 2 are close to each other, two adjacent supporting feet 2 may be partially overlapped; or, when the supporting feet 2 are close to each other, two adjacent supporting feet 2 may be arranged at intervals; alternatively, when the supporting feet 2 are close to each other, the two adjacent supporting feet 2 may just be in contact. Based on the above, it can be considered that the arrangement state when the supporting feet 2 are folded is not limited on the premise that the supporting feet 2 can be close to each other and stored on the surface of the base body 1.

Optionally, at least two supporting feet 2 can be installed on the base body 1, that is to say, the two supporting feet 2 can rotate relative to the base body 1 so that the extension lines of the two supporting feet 2 are parallel or intersect to achieve the support effect.

Optionally, more than two supporting feet 2 can be installed on the base body 1. On the premise that the supporting feet 2 can be unfolded relative to the base body 1 and support is achieved, the number of supporting feet 2 provided on the base body 1 is not limited.

In another embodiment of the present disclosure, three positioning posts 141 are convexly formed on the surface of the base 14, and the three positioning posts 141 are arranged on the same circumference. Moreover, the angle between two adjacent positioning posts 141 connected to the central axis of the base 14 to form two connecting lines is 120°. The lamp base 14 includes three supporting feet 2. One of the supporting feet 2 is rotatably provided on one of the positioning posts 141.

In an embodiment of the present disclosure, as shown in FIGS. 4 to 6, the base body 1 includes: a connecting portion 12, a base 14 provided on the connecting portion 12, and elastic members 15. The elastic members 15 are configured to connect the supporting feet 2 and the base 14 so that any one of the supporting feet 2 has a certain sense of damping when rotating, which improves the stability of the supporting feet 2. Details are as follows:

As shown in FIG. 5, the connecting portion 12 is configured to electrically connect with the light emitting module 5, and a surface of the connecting portion 12 away from the light emitting module 5 is provided with a mounting groove 121. That is to say, the connecting portion 12 may be configured to provide a connecting structure for supporting and fixing the light emitting module 5. Moreover, the connecting structure is a metal contact or a metal plug, and the connecting structure is also electrically connected to the light emitting module 5.

As shown in FIG. 2, FIG. 4 and FIG. 6, the base 14 is connected to the connecting portion 12 and configured to cover a notch of the mounting groove 121. The positioning posts 141 are provided on a surface of the base 14 away from the connecting portion 12. A surface of the base 14 towards the connecting portion 12 is convexly provided with mounting pins 144. One of the mounting pins 144 and one of the positioning posts 141 are misplaced, the base 14 is also provided with avoiding grooves 142. One of the avoiding grooves 142 is adjacent to one of the positioning posts 141 and one of the mounting pins 144. In the present embodiment, when the avoiding groove 142 is an arc-shaped groove, the positioning post 141 may be located at the center of the circle corresponding to the arc-shaped groove, and the mounting pin 144 and the positioning groove are arranged in a misplaced manner, such that the mounting pin 144 is a structure offset from the center of the circle. On the other hand, the avoiding groove 142 may also be a rectangular groove or a strip groove. At this time, the mounting pin 144 may be disposed adjacent to the peripheral edge of the base 14.

As shown in FIG. 6, one end of the elastic member 15 is connected to a mounting pin 144, and the other end is connected to a support foot 2 to achieve a reaction force to the support foot 2 when the support foot 2 rotates, to produce a certain sense of damping, and improve the control experience of the product. The elastic member 15 may be a structure such as a snap spring, a torsion spring and a tension spring.

In the present embodiment, a side of each of the supporting feet 2 towards the base 14 is convexly provided with a positioning pin 21, the positioning pin 21 is slidably penetrated in the avoiding groove 142 and connected to one end of one of the elastic members 15 away from one of the mounting pins 144, and the elastic member 15 is configured to apply a force to the mounting pin 144 towards either end of the avoiding groove 142.

In the present embodiment, elastic members 15 are provided on the base 14, and the elastic members 15 are respectively connected to the supporting feet 2. Therefore, when the supporting foot 2 rotates, a reaction force is given to the supporting foot 2 to generate a certain sense of damping. Taking the connection between the base 14 and one of the elastic members 15 and the supporting foot 2 as an example, a mounting pin 144 is protrudingly provided on the base 14, the mounting pin 144 is provided adjacent to the avoiding groove 142, and the supporting foot 2 is provided with a positioning pin 21. The positioning pin 21 is penetrated in the avoiding groove 142, the positioning pin 21 can move in the avoiding groove 142, the positioning pin 21 moves away from or close to the mounting pin 144 when moving. That is, both ends of the elastic member 15 are connected to the mounting pin 144 and the positioning pin 21, respectively.

When the supporting foot 2 rotates relative to the base body 1 and the supporting foot 2 partially protrudes with the periphery of the base body 1, the supporting foot 2 and the positioning pin 21 interlock. The positioning pin 21 is moved in the avoiding groove 142, so that the positioning pin 21 is away from the mounting pin 144, and the positioning pin 21 and the mounting pin 144 pull the elastic member 15 to each other to form a damping feeling. On the other hand, since the positioning pin 21 is provided on the supporting foot 2, when the positioning pin 21 moves beyond a certain formation, the positioning pin 21 and the inner wall surface of the avoiding groove 142 have a certain resistance effect, such that the positioning pin 21 is pressed against a predetermined position to realize the unfolding of the supporting foot 2.

In an embodiment of the present disclosure, as shown in FIG. 4 and FIG. 5, the connecting portion 12 may include a housing (not shown) and a circuit assembly 13. The housing is provided with a mounting groove 121, the circuit assembly 13 is provided in the mounting groove 121, the base 14 is connected to the housing, and configured to cover the mounting groove 121.

The housing is also provided with a wire through hole that communicates with the bottom wall of the mounting groove 121. The circuit assembly 13 includes a circuit board and a module mounting base structure provided in the mounting groove 121. The module mounting base structure is provided on the side of the housing away from the mounting groove 121, and the module mounting base structure is electrically connected to the circuit board. The module mounting seat structure can be a metal contact or a metal plug.

Optionally, the circuit assembly 13 further includes a wire and a plug. The circuit assembly is connected to the plug through the wire, and the plug is connected to the power supply network.

Optionally, the mounting pins 144 are arranged on the same circumference.

In an embodiment of the present disclosure, as shown in FIG. 2, one end of the avoiding groove 142 is adjacent to a middle of the base 14, and another end of the avoiding groove 142 is adjacent to a periphery of the base 14. That is to say, when the lamp base assembly is in the unfolded state, the positioning pin 21 of the supporting foot 2 is located at an end of the avoiding groove 142 adjacent to the middle of the base 14; when the lamp base assembly is in the folded state, the positioning pin 21 of the supporting foot 2 is located at an end of the avoiding groove 142 adjacent to the periphery of the base 14.

Optionally, the avoiding groove 142 is an arc-shaped groove.

As shown in FIG. 6, a distance between the end of the avoiding groove 142 adjacent to the middle of the base 14 and the mounting pin 144 is La, a distance between the end of the avoiding groove 142 adjacent to the periphery of the base 14 and the mounting pin 144 is Lb, a distance between a middle of the avoiding groove 142 and the mounting pin 144 is Lc, La is less than Lc and no less than Lb.

In the present embodiment, La is less than Lc and no less than Lb. Take one of the supporting feet 2 as an example. When the positioning pin 21 of the supporting foot 2 moves from the end of the avoiding groove 142 adjacent to the middle of the base 14 to the middle of the avoiding groove 142, the elastic member 15 is continuously stretched and the elastic force increases to generate a damping feeling. When the positioning pin 21 of the supporting foot 2 moves from the middle end of the avoiding groove 142 to the end of the avoiding groove 142 adjacent to the periphery of the base 14, the elastic member 15 tends to return to the original state, and the elastic force decreases.

Based on the above, the avoiding groove 142 is an arc-shaped groove. When the lamp base assembly is in the folded state, the positioning pin 21 of the supporting foot 2 is at the end of the avoiding groove 142 adjacent to the middle of the base 14; at this time, the elastic member 15 may be in the original state, or the elastic member 15 is in a critical state between the stretched state and the original state. The elastic member 15 has a certain pulling effect on the supporting foot 2, and there is a certain resistance between the positioning pin 21 and the inner wall surface of the arc-shaped groove, to avoid that the supporting foot 2 rotates relative to the base 14 when the lamp base assembly is vibrated.

When the lamp base assembly is in the unfolded state, the state of the elastic member 15 is similar in the unfolded state and the folded state. At this time, the elastic member 15 may be in the original state, or the elastic member 15 is in a critical state between the stretched state and the original state. The elastic member 15 has a certain pulling effect on the supporting foot 2, and there is a certain resistance between the positioning pin 21 and the inner wall surface of the arc-shaped groove, to avoid that the supporting foot 2 rotates relative to the base 14 when the lamp base assembly is vibrated.

In other embodiments, the avoiding groove 142 may also be provided as a groove body having a larger size than the above-mentioned arc-shaped groove, and may also achieve the same function.

In an embodiment of the present disclosure, as shown in FIG. 2, a surface of the base 14 away from the connecting portion 12 is provided with convex portions 143, and one of the convex portions 143 is adjacent to one of the positioning posts 141. In this embodiment, the convex portion 143 partially protrudes from the surface of the base 14. When in the folded state, the supporting feet 2 are close to each other, and are stacked on the surface of the base 14 away from the light emitting module 5. At this time, a surface of the supporting foot 2 towards the base 14 resists a convex portion 143 and cooperates with the rotatable portion of the supporting foot 2 and the base 14 to further position the supporting foot 2.

In an embodiment of the present disclosure, as shown in FIG. 2 and FIG. 3, a side of each of the supporting feet 2 away from the base body 1 is provided with an avoiding slot 22. The lamp base assembly further includes anti-skid pads 3, and one of the anti-skid pads 3 is provided at the avoiding slot 22.

In an embodiment of the present disclosure, the shape of the supporting feet may be substantially round or substantially square after being folded, such as when applied to a desk lamp.

In the present embodiment, each supporting foot 2 is provided with the anti-skid pad 3. When the lamp base assembly is in the unfolded state, the supporting feet 2 can resist the table top on which the lamp holder assembly is placed, and increase the coefficient of friction with the table top through the anti-skid pad 3 to avoid the sliding of the lamp base assembly.

Optionally, the anti-skid pad 3 may be made of rubber.

In an embodiment of the present disclosure, as shown in FIG. 2, FIG. 4. FIG. 6 and FIG. 7, a mounting portion 16 is provided in a middle of the base body 1, the supporting feet 2 are configured to surround the mounting portion 16. The lamp base assembly further includes a hanger ear 4 detachably connected to the mounting portion 16.

In the present embodiment, the mounting portion 16 is provided in the middle of the base 14, and the hanger ear 4 is mounted on the mounting portion 16, such that the hanger ear 4 is used as a booster to hang the lamp base assembly on the beam or the frame.

Optionally, the mounting portion 16 may be protrudingly provided on the surface of the base 1.

Optionally, the hanger ear 4 may be a hanging ring, a handle device or a hook.

In an embodiment of the present disclosure, as shown in FIG. 4, the mounting portion 16 is provided with an avoiding recess 161 adjacent to each of the supporting feet 2.

In the present embodiment, the mounting portion 16 is provided with avoiding recesses 161, and one of the avoiding recesses 161 is disposed adjacent to a supporting foot 2, to provide an avoidance space, such that the user can use it as a space for accommodating the hand to rotate the supporting foot 2.

The present disclosure further provides a lamp. As shown in FIG. 1, FIG. 7 and FIG. 8, the lamp includes a light emitting module 5 and the above lamp base assembly. The specific structure of the lamp base assembly refers to the above embodiments. Since this lamp adopts all the technical solutions of all the above-mentioned embodiments, it has at least all the beneficial effects brought by the technical solutions of the above-mentioned embodiments, which will not be repeated here. The light emitting modules 5 are disposed on the base body 1 of the lamp base assembly, and are electrically connected to the base body 1.

In the present embodiment, a mounting position may be provided on the base body 1 of the lamp base assembly, and the mounting position may be provided with a metal contact or a metal plug. The light emitting module 5 can be set corresponding to the mounting position of the base body 1 and electrically connected with the metal contact or the metal plug, so that the base body 1 provides power to the light emitting module 5.

Optionally, the light emitting module 5 may be an illumination lamp, an ultraviolet fluorescent lamp, or the like.

In an embodiment of the present disclosure, the lamp further includes: a reflecting cover 6, protective collar 8, and a sensing component 9.

The reflecting cover 6 is provided on a surface of the base body 1 away from the supporting feet 2, a receiving groove 7 is provided on a periphery of the reflecting cover 6, and the light emitting module 5 is received in the receiving groove 7. Understandably, the inner wall surface of the receiving groove 7 may be a curved surface, and the reflecting cover 6 may be made of aluminum alloy, so as to reflect the light through the receiving groove 7 and improve the using efficiency of light.

The protective collar 8 are sleeved on the reflecting cover 6, and the protective collars 8 are spaced apart from the base body 1 to form a light passing area. Understandably, the protective collars 8 may be connected to the reflecting cover 6 and disposed across the notch of the receiving groove 7 to effectively protect the light emitting module 5.

The sensing component 9 is provided on a side of the reflecting cover 6 away from the base body 1, and the sensing component 9 is electrically connected to the base body 1 through a wire. Understandably, the sensing component 9 may include an infrared sensor and/or a microwave sensor to effectively identify whether there is a person in the environment, and cooperate with the base body 1 to control the light module to turn on or off.

In the present embodiment, the light emitting module 5 may be an ultraviolet fluorescent lamp. The sensing component 9 cooperates with the base body 1, and when it is recognized that there is a human body in the environment, the base body 1 disconnects the power supply connected to the light emitting module 5 to prevent the light emitting module 5 from generating ultraviolet rays and to prevent the ultraviolet rays from damaging the human body. The sensing component 9 cooperates with the seat body 1, and when it is recognized that there is no human body in the environment, the base body 1 connects the power supply connected to the light emitting module 5, such that the light emitting module 5 generates ultraviolet rays to achieve sterilization and disinfection of the environment.

In the present embodiment, the light emitting module 5 may be an illumination lamp tube. The sensing component 9 cooperates with the base body 1, and when it is recognized that there is a human body in the environment, the base body 1 connects the power supply connected to the illumination lamp tube to realize the illumination of the environment. The sensing component 9 cooperates with the base body 1 and when it is recognized that there is no human body in the environment, the base body 1 disconnects the power supply connected to the illumination lamp tube to avoid waste of resources.

Optionally, the reflecting cover may be provided with receiving grooves. The receiving grooves are provided around the periphery of the reflecting cover. The light emitting module may include a plurality of ultraviolet fluorescent lamps. An ultraviolet fluorescent lamp is disposed in a receiving groove, and the ultraviolet fluorescent lamps are electrically connected to the base body.

Optionally, the reflecting cover may be provided with receiving grooves. The receiving grooves are provided around the periphery of the reflecting cover. The light emitting module may include a plurality of illumination lamps. An illumination lamp is disposed in a receiving groove, and the illumination lamps are electrically connected to the base body.

The above are only preferred embodiments of the present disclosure and are not intended to limit the scope of the present disclosure. Under the creative concept of the present disclosure, equivalent structural transformations made by the description and drawings of the present disclosure are included in the scope of the present disclosure.

What is claimed is:

1. A lamp base assembly for mounting a light emitting module, the lamp base assembly comprising:

a base body, the light emitting module being provided on a surface of the base body; and supporting feet, the supporting feet being movably provided on a surface of the base body away from the light emitting module, wherein the supporting feet are configured to move relative to the base body and protrude from a periphery of the base body when the lamp base assembly is in an unfolded state, and the supporting feet are configured to move relative to the base body and close to each other when the lamp base assembly is in a folded state, wherein a surface of the base body towards the supporting feet is convexly provided with positioning posts, the positioning posts are provided along a periphery of the base body, wherein each of the supporting feet is provided with a mounting hole, a fixing member is connected to the positioning post through the mounting hole, thereby the supporting feet are rotatably provided on the base body, wherein the base body comprises:

a connecting portion configured for electrically connecting with the light emitting module, a surface of the connecting portion away from the light emitting module being provided with a mounting groove;

a base connected to the connecting portion and configured to cover a notch of the mounting groove, the positioning posts being provided on a surface of the base away from the connecting portion, a surface of the base towards the connecting portion being convexly provided with mounting pins, one of the mounting pins and one of the positioning posts being misplaced, the base being also provided with avoiding grooves, one of the avoiding grooves being adjacent to one of the positioning posts and one of the mounting pins; and elastic members, one end of one of the elastic members being connected to one of the mounting pins, and wherein a side of each of the supporting feet towards the base is convexly provided with a positioning pin, the positioning pin being slidably penetrated in the avoiding groove and connected to one end of one of the elastic members away from one of the mounting pins, the elastic member being configured to apply a force to the mounting pin towards either end of the avoiding groove.

2. The lamp base assembly of claim 1, wherein one end of the avoiding groove is adjacent to a middle of the base, and another end of the avoiding groove is adjacent to a periphery of the base;

a distance between the end of the avoiding groove adjacent to the middle of the base and the mounting pin is LA, a distance between the end of the avoiding groove adjacent to the periphery of the base and the mounting pin is LB, a distance between a middle of the avoiding groove and the mounting pin is LC, and wherein LA is less than LC and no less than LB.

3. The lamp base assembly of claim 1, wherein the surface of the base away from the connecting portion is provided with convex portions, and one of the convex portions is adjacent to one of the positioning posts.

4. The lamp base assembly of claim 1, wherein a side of each of the supporting feet away from the base body is provided with an avoiding slot, and wherein the lamp base assembly further comprises anti-skid pads, and one of the anti-skid pads is provided at the avoiding slot.

5. The lamp base assembly of claim 1, wherein a mounting portion is provided in a middle of the base body, the supporting feet are configured to surround the mounting portion, and wherein the lamp base assembly further comprises a hanger ear detachably connected to the mounting portion.

6. The lamp base assembly of claim 5, wherein the mounting portion is provided with an avoiding recess adjacent to each of the supporting feet.

7. A lamp, the lamp comprising a light emitting module and a lamp base assembly, the lamp base assembly comprising:

a base body, the light emitting module being provided on a surface of the base body; and supporting feet, the supporting feet being movably provided on a surface of the base body away from the light emitting module, wherein the supporting feet are configured to move relative to the base body and protrude from a periphery of the base body when the lamp base assembly is in an unfolded state, and the supporting feet are configured to move relative to the base body and close to each other when the lamp base assembly is in a folded state, wherein the light emitting module is provided on the base body of the lamp base assembly, wherein a surface of the base body towards the supporting feet is convexly provided with positioning posts, the positioning posts are provided along a periphery of the base body, wherein each of the supporting feet is provided with a mounting hole, a fixing member is connected to the positioning post through the mounting hole, thereby the supporting feet are rotatably provided on the base body, wherein the base body comprises:

a connecting portion configured for electrically connecting with the light emitting module, a surface of the connecting portion away from the light emitting module being provided with a mounting groove;

a base connected to the connecting portion and configured to cover a notch of the mounting groove, the positioning posts being provided on a surface of the base away from the connecting portion, a surface of the base towards the connecting portion being convexly provided with mounting pins, one of the mounting pins and one of the positioning posts being misplaced, the base being also provided with avoiding grooves, one of the avoiding grooves being adjacent to one of the positioning posts and one of the mounting pins; and elastic members, one end of one of the elastic members being connected to one of the mounting pins, and wherein a side of each of the supporting feet towards the base is convexly provided with a positioning pin, the positioning pin being slidably penetrated in the avoiding groove and connected to one end of one of the elastic members away from one of the mounting pins, the elastic member being configured to apply a force to the mounting pin towards either end of the avoiding groove.

8. The lamp of claim 7, wherein the lamp further comprises:

a reflecting cover, the reflecting cover being provided on a surface of the base body away from the supporting feet, a receiving groove being provided on a periphery of the reflecting cover, the light emitting module being received in the receiving groove;

protective collars sleeved on the reflecting cover, the protective collars being spaced apart from the base body to form a light passing area; and a sensing component, the sensing component being provided on a side of the reflecting cover away from the base body, the sensing component being electrically connected to the base body through a wire.

9. The lamp of claim 7, wherein one end of the avoiding groove is adjacent to a middle of the base, and another end of the avoiding groove is adjacent to a periphery of the base;

a distance between the end of the avoiding groove adjacent to the middle of the base and the mounting pin is LA, a distance between the end of the avoiding groove adjacent to the periphery of the base and the mounting pin is LB, a distance between a middle of the avoiding groove and the mounting pin is LC, and wherein LA his less than Lc and no less than Lb.

10. The lamp of claim 7, wherein the surface of the base away from the connecting portion is provided with convex portions, and one of the convex portions is adjacent to one of the positioning posts.

11. The lamp of claim 7, wherein a side of each of the supporting feet away from the base body is provided with an avoiding slot, and wherein the lamp base assembly further comprises anti-skid pads, and one of the anti-skid pads is provided at the avoiding slot.

12. The lamp of claim 7, wherein a mounting portion is provided in a middle of the base body, the supporting feet are configured to surround the mounting portion, and wherein the lamp base assembly further comprises a hanger ear detachably connected to the mounting portion.

13. The lamp of claim 12, wherein the mounting portion is provided with an avoiding recess adjacent to each of the supporting feet.

* * * * *